US005601335A

United States Patent [19]

Woods et al.

[11] Patent Number: 5,601,335

[45] **Date of Patent: *Feb. 11, 1997**

[54] AUDITORIUM SEATING SYSTEM

[75] Inventors: David C. Woods, Quakertown, Pa.; Richard A. Koprowski, Green Bay, Wis.

[73] Assignee: Krueger International, Inc., Green Bay, Wis.

[ * ] Notice: The portion of the term of this patent subsequent to Feb. 28, 2012, has been disclaimed.

[21] Appl. No.: 335,246

[22] Filed: Nov. 7, 1994

Related U.S. Application Data

[63] Continuation of Ser. No. 959,980, Oct. 13, 1992, Pat. No. 5,393,120.

[51] Int. Cl.[6] ..... A47C 3/00

[52] U.S. Cl. ..... 297/301.3; 297/332; 297/292

[58] Field of Search ..... 297/292, 337, 297/335, 331, 332, 333, 301.3, 301.5, 301.1

[56] References Cited

U.S. PATENT DOCUMENTS

| | | |
|---|---|---|
| 444,101 | 1/1891 | Miller . |
| 1,435,741 | 11/1922 | Sadler . |
| 1,437,630 | 12/1922 | Zimmerli . |
| 2,124,893 | 7/1938 | Peppas . |
| 2,336,128 | 12/1943 | Ronk . |
| 2,560,925 | 7/1951 | Brown . |
| 2,582,599 | 1/1952 | Nordmark . |
| 2,705,526 | 4/1955 | Hoven . |
| 2,796,920 | 6/1957 | Cowles . |
| 2,913,039 | 11/1959 | Mauser . |
| 3,163,409 | 12/1964 | Running et al. . |
| 3,194,601 | 7/1965 | Hoven et al. . |
| 3,272,555 | 9/1966 | Barecki et al. . |
| 3,572,826 | 3/1971 | Barnes . |
| 3,638,998 | 2/1972 | Anderson . |
| 3,813,149 | 5/1974 | Lawrence . |
| 3,820,845 | 6/1974 | Persson . |
| 4,049,315 | 9/1977 | Jacobson . |
| 4,189,876 | 2/1980 | Crossman et al. . |
| 4,211,450 | 7/1980 | Sutter . |
| 4,400,031 | 8/1983 | DeDecker . |
| 4,458,943 | 7/1984 | Krakauer . |
| 4,502,731 | 3/1985 | Snider . |
| 4,575,150 | 3/1986 | Smith . |
| 4,756,575 | 7/1988 | Dicks . |
| 4,861,108 | 8/1989 | Acton et al. . |
| 5,393,120 | 2/1995 | Woods ..... 297/306 |

FOREIGN PATENT DOCUMENTS

| | | |
|---|---|---|
| 0669162 | 12/1938 | Germany . |
| 0235586 | 3/1926 | United Kingdom . |

*Primary Examiner*—Joseph J. Hail, III
*Assistant Examiner*—James Miner
*Attorney, Agent, or Firm*—Andrus, Sceales, Starke & Sawall

[57] ABSTRACT

A seating assembly, such as for use in auditorium seating, includes a pair of spaced frame assemblies and a seat and back, each of which is mounted between the frame assemblies. The seat assembly is mounted to the frame assemblies by means of an internal pivoting arrangement providing movement of the seat between an occupied position and an unoccupied, storage position in which the seat is substantially vertical. A biasing arrangement, such as a counterweight, moves the seat toward its storage position. The back is mounted between the frame assemblies by a pivoting back mounting arrangement, providing articulating movement of the back according to the position of the sitter's back. A biasing arrangement, such as a torsion spring, is associated with the back mounting arrangement for moving the back toward a storage position when the seat is unoccupied. The storage position of the back is substantially vertical, to provide a thin depth of approximately 13 inches to the seating assembly when the seat and back are both in their storage positions.

8 Claims, 5 Drawing Sheets

FIG. 9
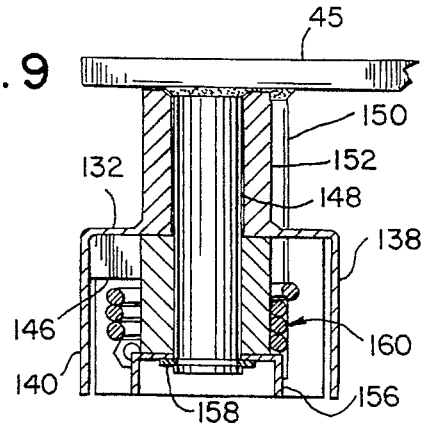
FIG. 12
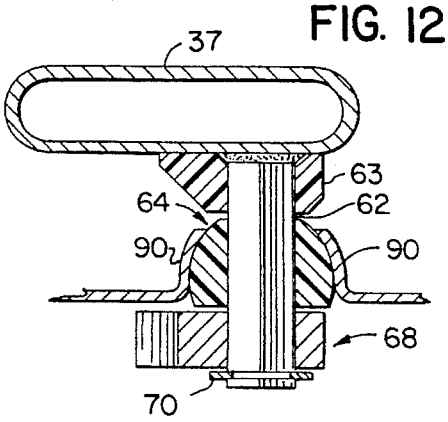
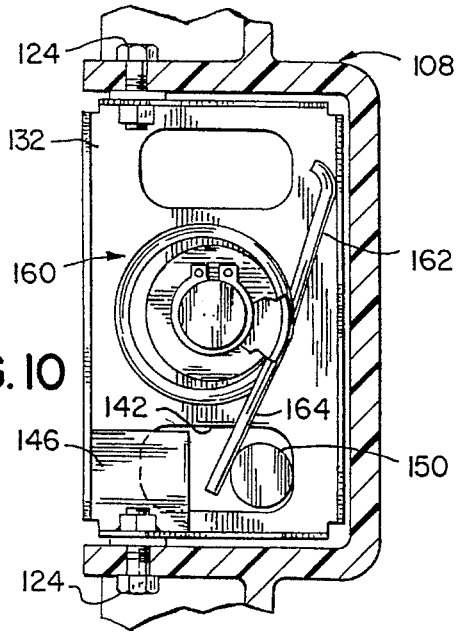
FIG. 10
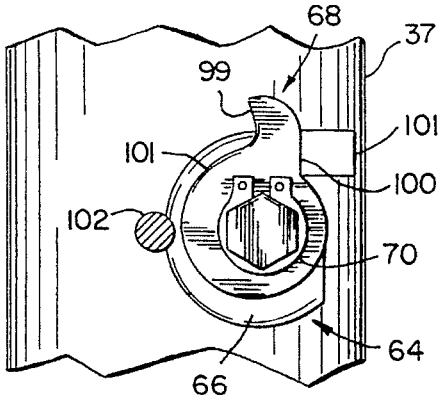
FIG. 13
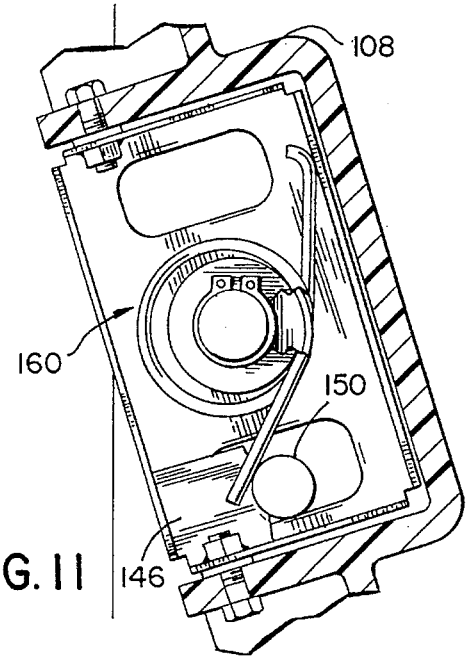
FIG. 11
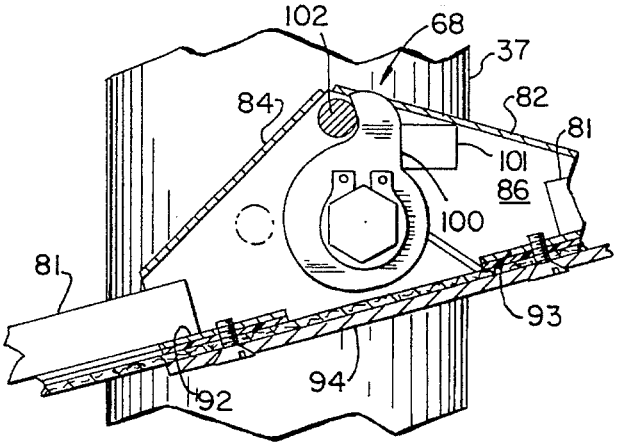
FIG. 14

AUDITORIUM SEATING SYSTEM

CROSS REFERENCE TO RELATED APPLICATION

This application is a continuation of application Ser. No. 07/959,980, filed Oct. 13, 1992, now U.S. Pat. No. 5,393,120.

BACKGROUND AND SUMMARY

This invention pertains to a seating assembly, and more particularly to a seating assembly for use in an auditorium or the like.

Auditorium seating typically includes a seat and a back mounted to a frame assembly, with the back being fixed and the seat being pivotable throughout a range of movement. This type of seating is often occupied for fairly long periods of time without providing the sitter an opportunity to stand or move about to relieve muscle tension or discomfort. The sitter will often move about within the seat in an effort to relieve muscle tension and discomfort and find a comfortable position. The fixed back provided by typical auditorium seating systems limits the sitter's efforts since it is not movable from its predetermined fixed position. Thus, the only option available in attaining a comfortable position is for the user to continually move about within the seat to adjust the position of the sitter's spinal column.

It is an object of the present invention to provide an auditorium seating system having a high degree of comfort for the sitter. A further object of the invention is to provide an auditorium seating system in which the seat and back provide a narrow folded unoccupied depth of approximately 13 inches, to allow more seating to be placed within a room than is possible with conventional auditorium seating systems while maintaining adequate aisle space between adjacent rows of seating without encroaching upon aisle widths typically specified by local fire regulations. Yet another object of the invention is to provide an auditorium seating system having a distinctive, aesthetically appealing appearance. A still further object of the invention is to provide an auditorium seating system capable of installation in a wide range of mounting arrangements.

The auditorium seating system of the present invention accomplishes the noted objects by incorporating several unique features into the seating system.

In accordance with one aspect of the invention, a seating assembly includes a pair of spaced frame members, with a seat and a back located between the frame members. A seat mounting mechanism provides movement of the seat between a storage position and an occupied position, and a first biasing system is provided for moving the seat toward its storage position when the seating assembly is unoccupied. The back is mounted between the frame members by a back mounting mechanism which also provides movement of the back between a storage position and an occupied position. A second biasing system is provided for moving the back to its storage position when the seating assembly is unoccupied. The seat and back are both mounted for pivoting movement between the frame members. The seat and the back are disposed substantially parallel to each other when each is in its storage position by operation of the seat and back mounting mechanisms cooperating with the first and second biasing systems, respectively. In a highly preferred arrangement, the seat and back are both substantially vertical when each is in its storage position. This feature provides a very narrow depth of approximately 13 inches when the seating assembly is in its folded, unoccupied position.

In accordance with another aspect of the invention, the seat is pivotably mounted between the frame members by a seat mounting mechanism which includes a pair of seat mounting assemblies, each of which is located between the seat and one of the frame members. Each seat mounting assembly includes a shaft extending from the frame member, a bushing fixedly mounted to the shaft, and a socket mounted to the seat. The bushing defines an arcuate outer surface, and the socket defines an internal cavity within which the bushing is received, with the internal cavity having an arcuate inner surface for mating with the arcuate outer surface of the bushing to provide pivoting movement of the seat relative to the frame member. A stop assembly limits the range of pivoting movement of the seat. The stop assembly includes a stop member fixedly mounted to each shaft, with each stop member defining first and second stop surfaces. A pin member is mounted to the seat and is movable with the seat during movement of the seat between its storage and occupied positions. The pin member is engageable with one of the stop surfaces of the stop member to define the range of downward pivoting movement of the seat. A resilient bumper is mounted to the other of the stop surfaces and is engageable with a plate member mounted to the seat to define the range of upward pivoting movement of the seat. In a preferred form of the invention, the socket is associated with a seat pivot housing which defines an interior within which the stop member is located, with the pin being mounted to the seat pivot housing. The seat is biased toward its storage position by means of a counterweight mounted to the seat, which functions to move the seat to its storage position when the seating assembly is unoccupied.

In accordance with yet another aspect of the invention, a back mounting mechanism for mounting the back between the frame members includes a shaft extending from each frame member, with the back being mounted for pivoting movement about a pivot axis defined by the shafts. A stop arrangement defines the range of pivoting movement of the back about the shafts. The stop arrangement limits pivoting movement of the back in a first direction to a substantially vertical, upright storage position. A biasing arrangement is interposed between the back and each shaft for biasing the back toward its storage position. The back is mounted to the shafts by a pair of back pivot housings, each of which is pivotably mounted to one of the shafts. Each back pivot housing includes a vertical wall and one or more side walls which define an internal cavity. The stop arrangement includes an opening formed in the vertical wall of each back pivot housing, and a stop pin interconnected with the frame member to which the pivot housing is mounted, with the stop pin extending through the opening. The opening defines a forward edge, and engagement of the stop pin with the forward edge of the opening limits movement of the back in a forward direction to its vertical, upright storage position. A bumper member formed of a resilient material is mounted to the back pivot housing in a location spaced rearwardly from the forward edge of the opening. Engagement of the stop pin with the bumper member limits rearward movement of the back but allows a controlled flexing action from a 0° position to a 30° position to accommodate the sitter's changes in position. The biasing arrangement includes a torsion spring engaged with a forward one of the pivot housing side walls and also engaged with the stop pin, for urging the stop pin toward the forward edge of the opening.

In accordance with a further object of the invention, each frame assembly includes an upright frame member defining an upper end and a lower end, and an upper support member mounted toward the upper end of each upright frame member and extending rearwardly therefrom. Each upper support member terminates in an outer end. The pivoting seat mounting arrangement is disposed below the upper end of each upright frame member for pivotably mounting the seat to each upright frame member. The pivoting back mounting arrangement is disposed toward the outer end of each upper support member for pivotably mounting the back to each upper support member.

Further objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 9 is a partial section view taken along line 9—9 of FIG. 6, showing the back mounting mechanism;

FIG. 10 is a partial side elevation view of the back mounting mechanism of FIG. 9, showing the back pivoted to its upright, storage position;

FIG. 11 is a view similar to FIG. 10, showing the back pivoted to its rearwardmost position;

FIG. 12 is a partial top plan view of the seat mounting mechanism somewhat similar to FIG. 8;

FIG. 13 is a side elevation view of the seat mounting mechanism of FIG. 12, illustrating the stop member;

FIG. 14 is a view similar to FIG. 13, showing the seat pivot housing as mounted to the seat mounting mechanism of FIG. 13, with the seat shown pivoted to its forwardmost position.

DETAILED DESCRIPTION OF THE INVENTION

Figure 1:
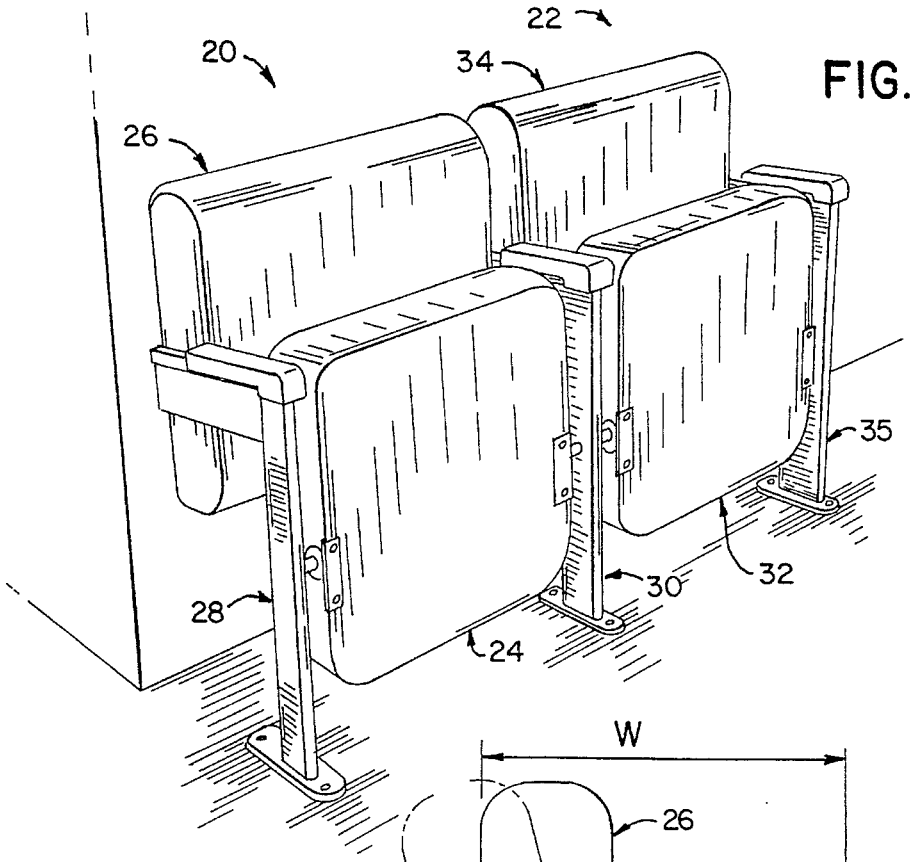
FIG. 1 is an isometric view showing two side-by-side seating assemblies constructed according to the invention.

FIG. 1 illustrates a pair of side-by-side seating assemblies 20, 22. Seating assemblies 20, 22 are of the type commonly referred to as auditorium seating. Typically, a series of seating assemblies such as 20, 22 are positioned side-by-side to form a row, and a series of such rows are installed in a room such as an auditorium, theater or hall. Adjacent rows are separated by an aisle.

The following description will specifically refer to seating assembly 20 for a detailed explanation of its construction and operation. It is understood, however, that seating assembly 22 and additional seating assemblies constructed in a row along with seating assemblies 20, 22, are constructed substantially identically to seating assembly 20 and operate in the same manner as seating assembly 20.

Seating assembly 20 generally consists of a seat 24 and a back 26 mounted between a frame assembly 28 and a frame assembly 30. Similarly, seating assembly 22 generally consists of a seat 32 and a back 34 mounted between frame assembly 30 and a frame assembly 35. Additional seating assemblies are interconnected with subsequent frame assemblies such as 28, 30 and 35, to form a row of seating in which each frame assembly, except the end frame assemblies such as 20, supports the seat and back of adjacent seating assemblies.

Figure 3:
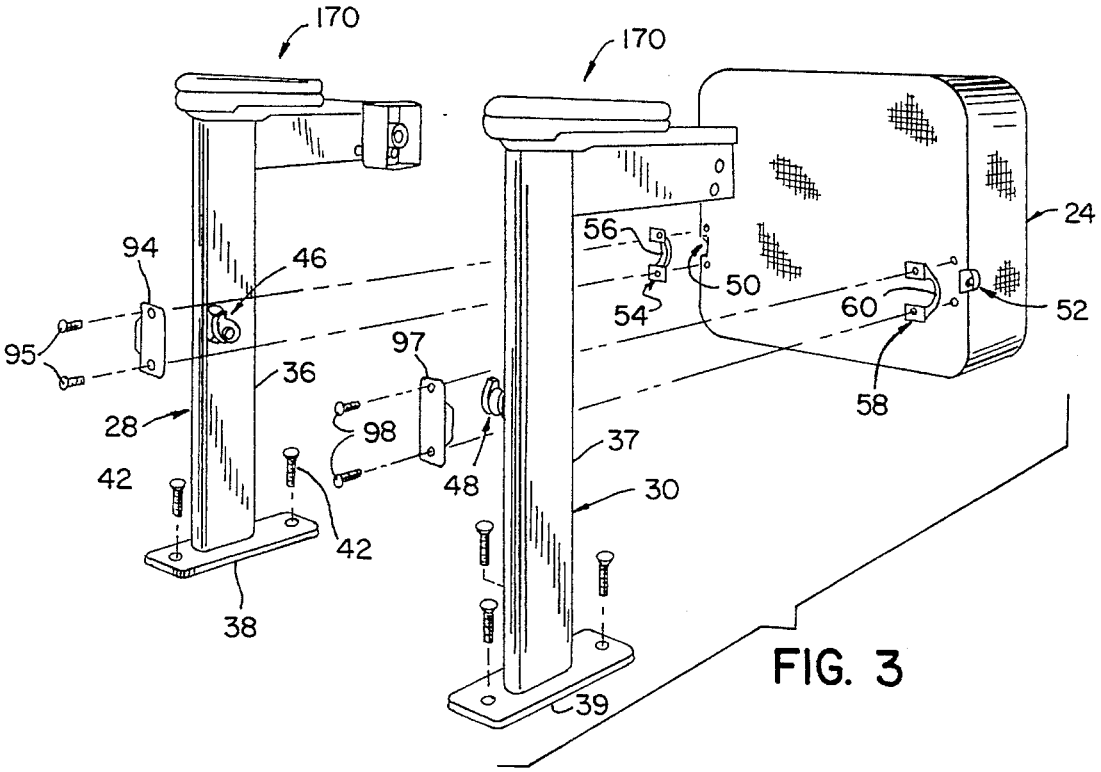
FIG. 3 is a partial exploded isometric view of one of the seating assemblies of FIG. 1, showing the manner in which the seat is mounted between the frame members.

Referring to FIG. 3, frame assemblies 28, 30 each include upright frame member 36, 37, respectively. Each of upright members 36, 37 has a foot plate, shown at 38, 39, respectively, mounted at its lower end.

Figure 2:
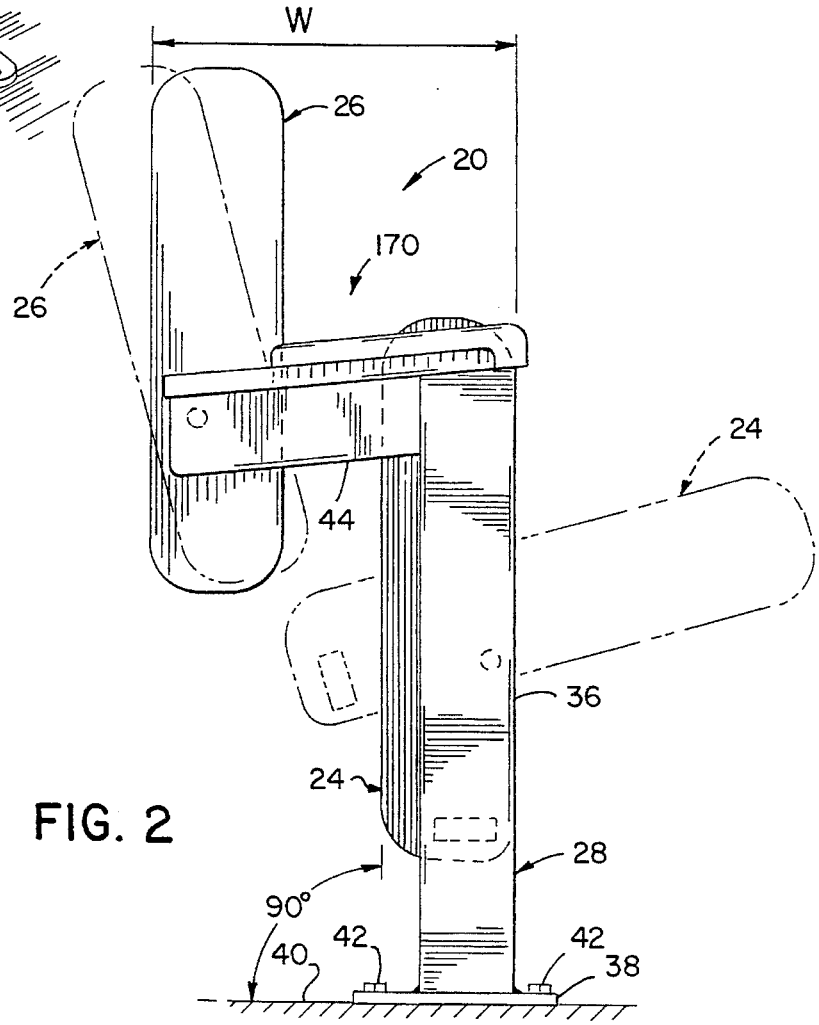
FIG. 2 is a side elevation view of one of the seating assemblies of FIG. 1.

As shown in FIG. 2, foot plates 38, 39 are mounted to a floor, shown at 40, by means of a pair of screws, bolts or other threaded fasteners, shown at 42, engaged with anchors (not shown) mounted to floor 40. When frame assemblies 28, 30 are mounted to floor 40, frame members 36, 37 are in an upright vertical position.

Frame members 36, 37 terminate in an upper end, and frame assemblies 28, 30 further include rearwardly and downwardly extending upper support members 44, 45 mounted to the upper ends of frame members 36, 37, respectively. Each of upper support members 44, 45 terminates in an outer end spaced rearwardly from its respective frame member 36, 37 with the inner end of support members 44, 45 mounted to the upper ends of frame members 36, 37, respectively, in any satisfactory manner, such as by welding or the like.

Frame members 36, 37 and 44, 45 as illustrated, are in the form of flattened tubular members. However, it is understood that any satisfactory structural member could be employed in place of the flattened tubular sections illustrated.

Frame assembly 35, as well as subsequent frame assemblies to which additional seating is mounted, are constructed substantially identically to frame assemblies 28, 30 as shown and described.

In addition, while upright frame members 36, 37 are shown mounted to floor 40 by foot plates such as 38 and bolts such as 42, it is understood that frame assemblies 28, 30 could also be satisfactorily mounted in any other manner, such as a riser or pedestal mount or mounted to a transverse beam or bar.

In a manner to be explained, seat 24 is mounted between upright frame members 36, 37 below the upper ends of upright frame members 36, 37, for pivoting movement between a storage position, shown in solid lines in FIG. 2, and an occupied position as shown in phantom in FIG. 2. Similarly, back 26 is mounted for pivoting movement between upper support members 44, 45 toward the outer ends of the upper support members, for pivoting movement between a storage position as shown in solid lines in FIG. 2 and an occupied position as shown in phantom in FIG. 2.

FIG. 3 illustrates mounting of seat 24 between upright frame members 36, 37 of frame assemblies 28, 30, respectively.

A seat mounting mechanism, shown generally at 46, is mounted to upright frame member 36 of frame assembly 28, and a mirror-image seat mounting mechanism 48 is mounted to upright frame member 37 of frame assembly 30. Seat 24 includes structure, which will later be described in detail, disposed along its lower side edges defining a pair of sockets, shown generally at 50, 52. A bezel 54 is mounted to the underside of seat 24, and includes an arcuate central portion 56 adapted for positioning along the side of seat 24 to enclose seat mounting mechanism 48. Similarly, a bracket 58 is mounted to the underside of 52 such that its arcuate central portion 60 is positioned along the opposite side of seat 24 to enclose seat mounting mechanism 46.

Figure 8:
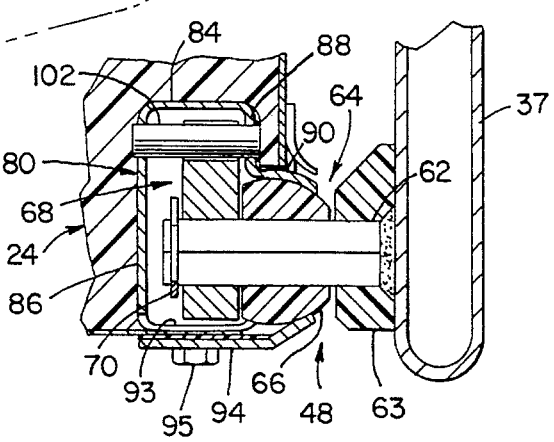
FIG. 8 is a partial section view taken along line 8—8 of FIG. 7.

Reference is briefly made to FIG. 8 for an explanation of the components associated with seat mounting mechanism 48. As shown in FIG. 8, seat mounting mechanism 48 includes a hexagonal shaft 62 mounted to upright frame member 37, and extending therefrom in a direction substantially perpendicular to the longitudinal axis of frame member 37. A spacer 63, having a hexagonal passage within which shaft 62 is received, is mounted to shaft 62 adjacent the surface of upright frame member 37 from which shaft 62 extends. A bushing 64, defining an arcuate outer surface 66, is mounted to shaft 62 by means of a hexagonal passage formed in bushing 64 within which shaft 62 is received. In this manner, bushing 64 is non-rotatable relative to shaft 62. In addition, a stop member 68 is mounted to shaft 62 outwardly of bushing 64. The details of construction and operation of stop member 68 will later be explained. Stop member 68 is mounted to shaft 62 in a manner similar to that of bushing 64, in that a hexagonal passage is formed in stop member 68 within which shaft 62 is received, to non-rotatably mount stop member 68 to shaft 62. A snap ring 70 is engaged within a circumferential groove formed in shaft 62 outwardly of stop member 68, for retaining stop member 68 and bushing 64 in position on shaft 62.

Referring again to FIG. 3, seat mounting mechanism 46 is substantially identical to seat mounting mechanism 48 as shown in FIG. 8 and described above, with seat mounting mechanism 46 being a mirror-image of seat mounting mechanism 48.

Figure 7:
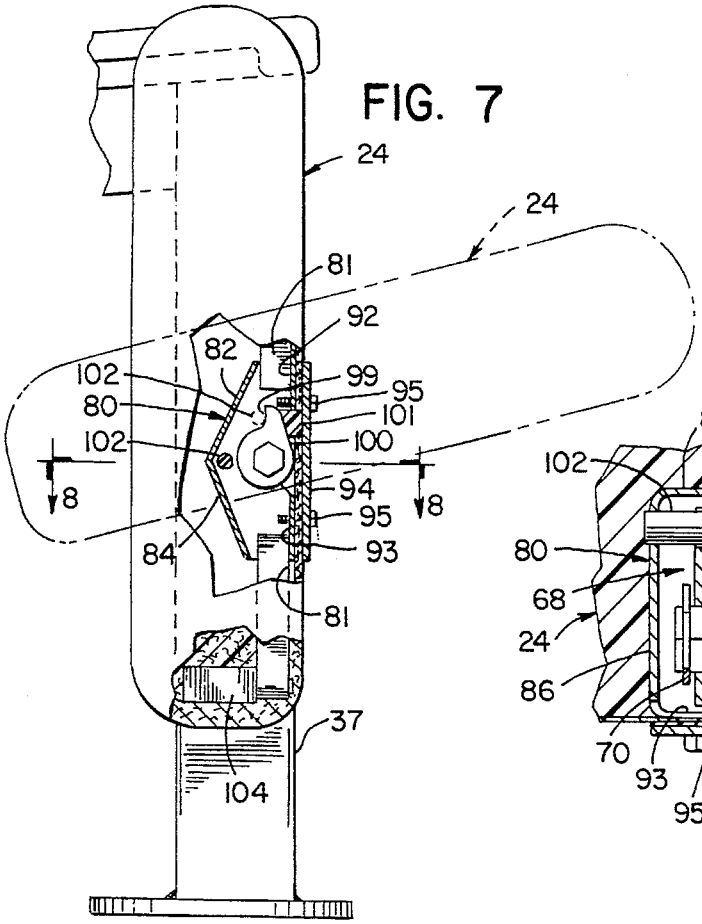
FIG. 7 is a partial side elevation view showing the seat, with a portion broken away to reveal the interconnection of the seat with the seat mounting mechanism.

With reference to FIGS. 7 and 8, a seat pivot housing 80 is located within the interior of seat 24. Seat pivot housing 80 is secured to a seat frame assembly, portions of which are shown at 81 in FIG. 7. Seat pivot housing 80 includes a pair of angled walls 82, 84, a side wall 86, a partial side wall 88 and an arcuate lip 90 located at the end of partial side wall 88. Arcuate lip 90 defines socket 52 (FIG. 3) within which bushing 64 is received to provide pivoting movement of seat 24. Seat pivot housing 80 further includes a pair of outer walls 92, 93 separated by a gap.

To pivotably mount seat 24 to frame members 37, seat 24 is moved rearwardly toward seat mounting mechanism 48 until the socket defined by lip 90 engages bushing 64. Simultaneously, stop member 68 is received within the interior of seat pivot housing 80 defined by wall 82–88. During rearward movement of seat 24, bushing 64 and stop member 68 pass through the gap located between outer walls 92, 93 of seat pivot housing 80.

A plate 94 is then mounted to the frame of seat 24 to capture bushing 64 between arcuate lip 90 and plate 94. Threaded fasteners, such as screws 95, are employed to extend through openings formed in plate 94 and in bracket 54 to mount plate 72 and bracket 54 to the underside of seat 24.

As stated previously, seat mounting mechanism 46 is substantially identical to seat mounting mechanism 48, being a mirror-image thereof. A plate 97 and screws 98 are employed to mount bracket 58 to the underside of seat 24 and to capture the bushing of seat mounting assembly 46 within socket 50 defined by the seat pivot housing on the side of seat 24 opposite seat pivot housing 80. The shafts, such as 62, of seat mounting mechanisms 46 and 48 extend coaxially, and define the axis about which seat 24 is pivotably mounted to frame members 36, 37 through the cooperating action of sockets 50, 52 and the arcuate outer surfaces, such as 66, of the bushings, such as 64, associated with seat mounting mechanisms 46, 48.

With the arrangement as described above, seat 24 is easily mountable to seat mounting assemblies 46, 48 simply by installing plates 94, 97 using fasteners 95, 98, respectively. In a similar manner, then, seat 24 can be easily removed from seat mounting assemblies 46, 48 simply by removing plates 94, 97, respectively and lifting seat 24 off of seat mounting assemblies 46, 48. With this arrangement, it is possible to quickly and easily remove seat 24 and replace it with a replacement seat 24.

Referring to FIG. 7, stop member 68 is a cam-shaped member defining a pair of stop surfaces 99, 100, with a rubber bumper 101 being mounted to stop surface 100. A stop pin, shown in FIGS. 7 and 8 at 102, extends between walls 86 and 88 of seat pivot housing 80, and is disposed adjacent stop surface 99. Stop pin 102 moves along with seat 24 as seat 24 is moved between it storage and occupied positions, with stop surface 99 defining the range of downward movement of seat 24. Pin 102 is movable between its solid line position as shown in FIG. 7, in which seat 24 is positioned vertically, and its phantom line position shown in FIG. 7, in which seat 24 is in its full-down occupied position in which pin 102 engages stop surface 99. A counterweight, shown at 104, is mounted in the internal rear portion of seat 24. Counterweight 104 functions to bias seat 24 toward its vertical storage position when seat 24 is unoccupied, in a manner as is known in the art. Bumper 101 engages plate 94 when seat 24 returns to its storage position, to silence and cushion the impact of plate 94 with stop surface 100.

FIGS. 12–14 illustrate seat mounting assembly 48, stop member 68, bumper 101 and seat pivot housing 80 in greater detail. FIG. 14 shows the position of seat pivot housing 80 when seat 24 is in its full-down occupied position.

Figure 4:
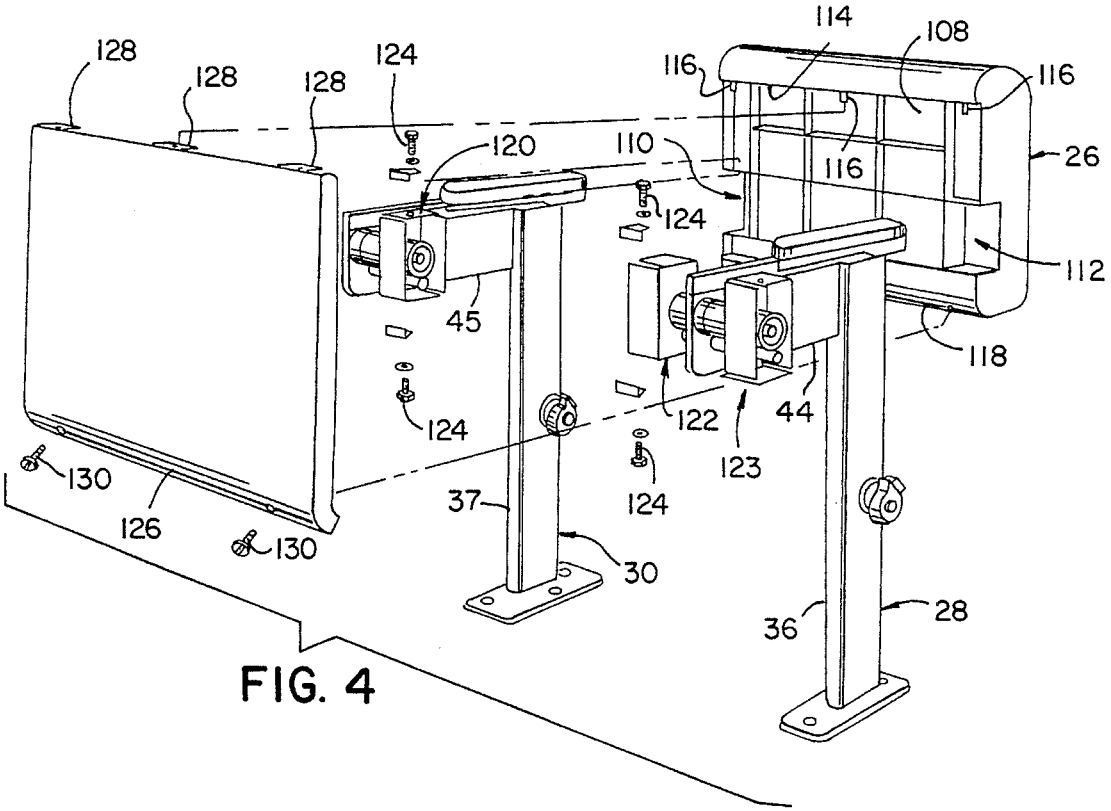
FIG. 4 is a partial exploded isometric view of one of the seating assemblies of FIG. 1, showing the manner in which the back is mounted between the frame members.
Figure 5:
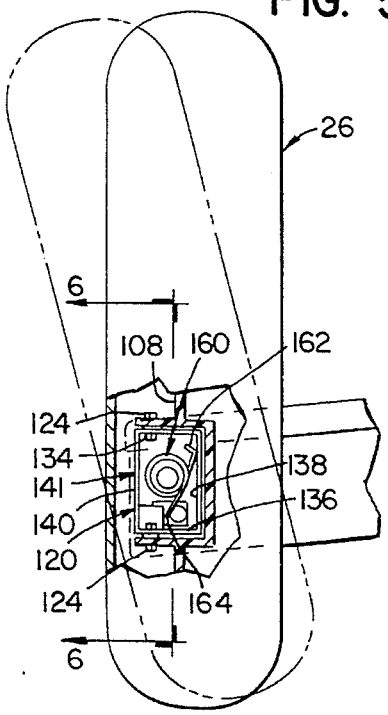
FIG. 5 is a partial side elevation view showing the seat back, with a portion broken away to reveal the interconnection of the seat back with the back mounting mechanism.
Figure 6:
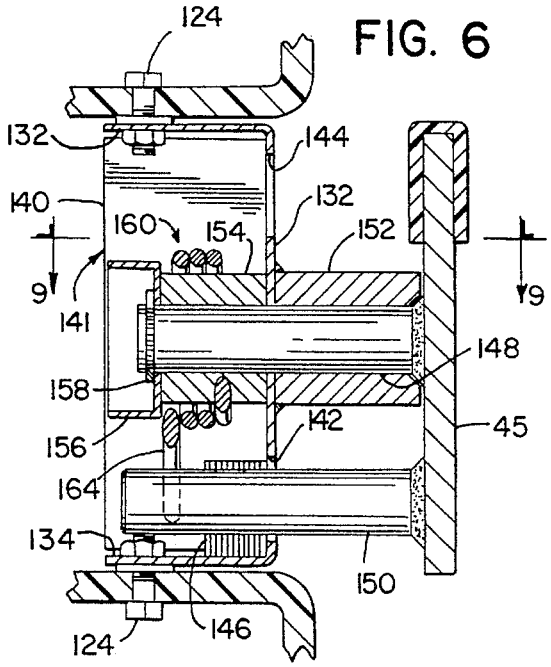
FIG. 6 is a partial sectional view taken along line 6—6 of FIG. 5.

Reference is now made to FIGS. 4, 5 and 6 for an explanation of the mounting of back 26 between upper support members 44, 45. As shown in FIG. 4, back 26 includes a reinforced back panel 108 which defines a pair of rectangular recesses 110, 112 located on opposite sides of back 26. Back panel 108 further includes a lip 114 from which a series of pins 116 extend downwardly. A lower curved surface 118 extends across back panel 108 at its lower end.

A back mounting assembly 120 is mounted to upper support member 45 of frame assembly 30, and a similar back mounting assembly 122 is mounted to upper support member 44 of frame assembly 28. The details of construction of back mounting assemblies 120, 122 will subsequently be described.

An additional back mounting assembly 123 is shown mounted to upper frame member 44. This construction is employed when frame assembly 28 is installed in the interior of a row of seating, and not at an end of the row as shown in FIG. 1.

Back mounting assemblies 120, 122 are received within rectangular recesses 110, 112 formed in back panel 108 of back 26. Threaded fasteners, such as bolts 124, are employed to mount back 26, through back panel 108, to back mounting assemblies 120, 122. With back 26 mounted to back mounting assemblies 120, 122, a back cover 126 is mounted to back panel 108 to enclose the rear of back panel 108 and the rear of back mounting assemblies 120, 122. Back cover 126 includes a series of tabs 128, with each tab 128 having an opening within which one of pins 116 is received. A pair of threaded fasteners, such as screws 130, mount the lower end of back cover 126 to curved lower surface 118 of back panel 108.

With the mounting arrangement for back 26 as shown and described, installation and removal of back 26 to and from back mounting assemblies 120, 122 is simply and easily accomplished by installation and removal, respectively of screws 130, back panel 126 and screws 124. In this manner, back 26 can easily be removed and replaced with a replacement back 26, if desired.

FIGS. 5 and 6 illustrate the construction of back mounting assembly 120 in detail. It is understood that back mounting assembly 122 is constructed substantially identically to back mounting assembly 120, being a mirror-image thereof.

As shown in FIGS. 5 and 6, back mounting assembly 120 consists of a housing defining a vertical outer wall 132, upper and lower side walls 134, 136, and front and back side walls 138, 140. Walls 132–140 cooperate to define a back pivot housing 141. Pivot housing 141 so defined by walls 132–140 is mounted to back panel 108 by interconnection of bolts 124 with upper and lower side walls 134, 136, respectively.

An opening 142 is formed in the lower portion of vertical outer wall 132, and an opening 144 is formed in the upper portion of vertical outer wall 132. A resilient bumper member 146 is mounted within the interior of pivot housing 141. The forward end of bumper 146 overlaps the rearward portion of opening 142.

By constructing seat pivot housing 141 as shown and described, housing 141 can be employed in a back mounting mechanism located on either side of back 20.

Referring to FIG. 6, a pivot shaft 148 is mounted to upper support member 45 such as by welding or the like. Similarly, a stop shaft 150 is mounted to upper support member 45 such as by welding or the like. Shafts 148, 150 are substantially perpendicular to the plane in which upper support member 45 lies.

Stop shaft 150 extends through opening 142 formed in the lower portion of vertical outer wall 132 of seat pivot housing 141.

A tubular barrel 152 is mounted to vertical wall 132 of seat pivot housing 141. Barrel 152 includes an axial passage within which shaft 148 is received, in order to pivotably mount seat pivot housing 141 to upper support member 45. A sleeve 154 is mounted to the outer end of shaft 148 within the interior of seat pivot housing 141, and a cup-shaped bushing 156 is mounted to shaft 148 adjacent the outer end of sleeve 154. A snap ring 158 is mounted within a circumferential groove formed toward the outer end of shaft 148, to secure bushing 156 and sleeve 154, and thereby seat pivot housing 141, to shaft 148.

A torsion spring, shown generally at 160, is mounted about sleeve 154 within the interior of seat pivot housing 141. Torsion spring 160 defines a pair of legs 162, 164. Leg 162 bears against the inner surface of vertical side wall 138 of seat pivot housing 141, and leg 164 bears against stop shaft 150.

The above-described components of seat mounting assembly 120 are illustrated in greater detail in FIGS. 9–11, and reference is made thereto for a description of the operation of seat mounting mechanism 120.

In operation, torsion spring 160 functions to bias seat 24 toward its upright, vertical storage position, as shown in FIG. 10. In this position, legs 162, 164 of torsion spring 160 function to move back 24 to a position in which stop shaft 150 is engaged with the forward edge of lower opening 142 formed in vertical housing wall 132. When a person sits on seat 24, the person's back engages back 26 to move back 26 away from its storage position, i.e. moving back 26 away from its vertical position according to the position of the sitter's back. Back 26 thus articulates to whatever position is desired by the sitter.

FIG. 11 illustrates the rearwardmost position of back 26. When back 26 is in the FIG. 11 position, the forward surface of resilient bumper 146 is engaged with stop shaft 150 which remains stationary on upper support member 45. The resiliency of bumper 146 prevents the sitter from experiencing a sudden stop when back 26 is pivoted rearwardly the full extent of its range of motion. Whenever the sitter changes the position of his or her back, back 26 pivots about pivot shaft 148 to adjust to the position of the sitter's back, to provide a high degree of comfort and support for the sitter.

In a prototype embodiment, opening 142 and bumper 146 are arranged relative to stop shaft 150 so as to provide a range of motion of approximately 30°.

When the sitter's back is removed from back 26, torsion spring 160 again functions to return back 26 to its FIG. 10 position, in which back 26 is upright and vertical. This feature of the invention, in combination with movement of seat 24 to its vertical storage position, allows seating assembly 20 to attain an unfolded depth, shown at W in FIG. 2, of approximately thirteen inches. This depth is extremely narrow in comparison to prior art seating assemblies which typically provide an angled back. The aisle space between adjacent rows of seating is typically dictated by local fire regulations, and is measured between the forwardmost point of the seat in one row and the rearwardmost point of the seat in the adjacent forward row. With both seat 24 and back 26 returning to a vertical upright position when seating assembly 20 is unoccupied, it is possible to install more rows of seating utilizing the features of the invention than is possible with prior art seating systems, due to the extremely thin depth of seating assembly 20 when seat 24 and back 26 are in their vertical storage positions.

Figure 15:
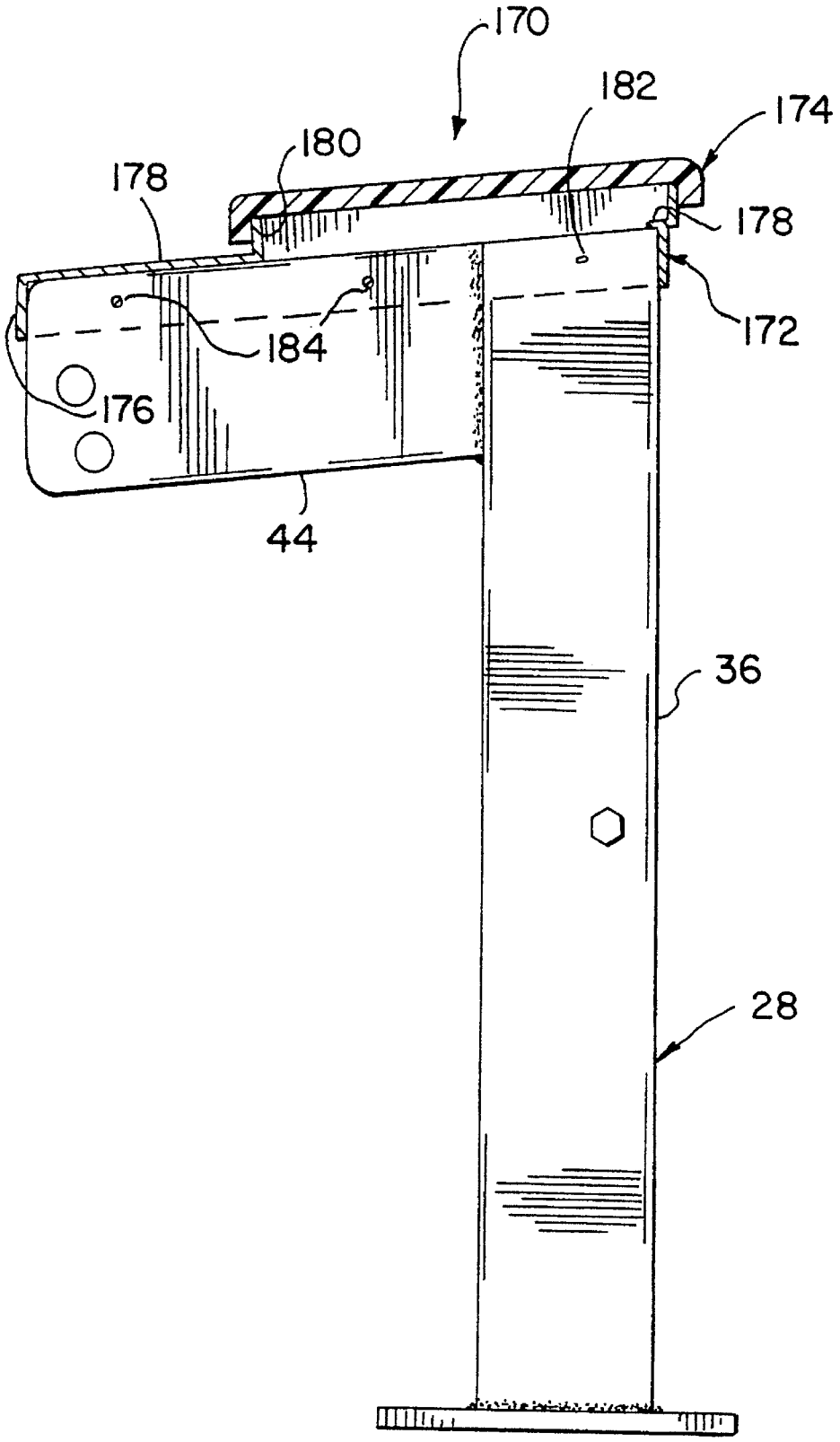
FIG. 15 is a partial elevation view showing one of the frame assemblies for use in seating assemblies constructed according to the invention.

Referring to FIG. 15, an arm cap assembly, shown generally at 170, is mounted to each frame assembly, such as frame assembly 28 as illustrated. Each arm cap assembly 170 includes an arm cap support 172 and a cap member 174 mounted to cap support 172. Cap support 172 defines a downwardly facing opening or socket which, when viewed in bottom plan, corresponds in shape to the upper plan of frame assembly 28 as defined by the upper end of upright frame member 36 and rearwardly extending support member 44. Arm cap support 172 includes a side wall 176 which defines the opening or socket within which the upper ends of support member 44 and upright frame member 36 are received, in combination with an upper wall 178. Arm cap support 172 further includes a cap mounting base 180 extending upwardly from upper wall 178. Cap member 174 is mounted to base 180 by means of threaded fasteners extending upwardly through the side portions of base 180 and into the underside of cap member 174. Cap member 174 may be constructed of an injection molded plastic material as shown, either alone or covered with a pad and upholstered, or alternatively may be constructed of a wood material. Arm cap support 172 is employed to mount cap member 174 constructed from any type of material. Arm cap support 172 is mounted to the upper end of upright frame member 36, through side wall 176, by a pin extending transversely through an opening 182 extending through the upper end of frame member 36, and to the upper end of upper support member 44 by a pin (not shown) extending through openings 184 formed in upper support member 44. With this arrangement, arm cap assembly 170 can be removed in its entirety by removing the pins extending through openings 182, 184 in order to install a replacement arm cap assembly 170. Alternatively, arm cap 174 itself can be removed from arm cap support 172 while arm cap 172 remains in place, in order to install a replacement arm cap 174.

The compact, trim lines provided by the seating assembly of the invention provide a distinct and aesthetically appealing appearance in auditorium seating.

Various alternatives and embodiments are contemplated as being within the scope of the following claims particularly pointing out and distinctly claiming the subject matter regarded as the invention.

We claim:

1. A seat mounting assembly for a seating assembly including a seat, for pivotably mounting the seat to a support, comprising:

a shaft extending from the support;

a bushing fixedly mounted to the shaft and defining a spherical outer surface; and a socket mounted to the seat and defining an inner surface having a contour corresponding to the spherical outer surface of the bushing for receiving and engaging the spherical outer surface of the bushing to provide pivoting movement of the seat relative to the support;

wherein the socket and the bushing provide the sole means of constant engagement between the seat and the support for pivotably mounting the seat to the support, and wherein the socket and the portion of the seat adjacent the socket are free from interference with the support to enable the seat to be moved through a range of angular positions relative to the shaft by movement of the socket on the bushing.

2. The seat mounting assembly of claim 1, wherein the shaft defines a pivot axis about which the seat is pivotably movable, and further comprising a stop member fixedly mounted to the shaft and defining first and second stop surfaces, and a pin member mounted to the seat and movable with the seat during movement of the seat, wherein the pin member is engageable with a first one of the stop surfaces to define the range of pivoting downward movement of the seat.

3. The seat mounting assembly of claim 2, wherein a second one of the stop surfaces is operable to position the seat in a substantially vertical storage position when the seating assembly is unoccupied, and further comprising a biasing arrangement for moving the seat toward its vertical storage position.

4. The seat mounting assembly of claim 3, wherein the seat defines a front end and a rear end, and wherein the biasing arrangement comprises a counterweight mounted toward the rear end of the seat.

5. The seat mounting assembly of claim 1, wherein the shaft defines a non-circular cross section, and wherein the bushing is fixedly mounted to the shaft by means of a passage formed in the bushing and defining a cross section corresponding to that of the shaft, wherein the shaft is received within the bushing passage to fixedly mount the bushing to the shaft.

6. The seat mounting assembly of claim 5, further comprising a stop member fixedly mounted to the shaft and defining first and second stop surfaces, and a pin member mounted to the seat and movable with the seat between its storage and occupied positions, wherein the pin member is engageable with a first one of the stop surfaces to define the range of pivoting downward movement of the seat.

7. The seat mounting assembly of claim 6, wherein the stop member is mounted to the shaft by means of a passage formed in the stop member having a cross section corresponding to that of the shaft, wherein the shaft is received within the passage formed in the stop member to fixedly mount the stop member to the shaft.

8. A seat mounting assembly for a seating assembly including a seat, for pivotably mounting the seat to a support, comprising:

a shaft extending from the support;

a bushing fixedly mounted to the shaft and defining a spherical outer surface; and a socket mounted to the seat and defining the outermost portion of the seat adjacent the support, the socket including an inner surface having a contour corresponding to the spherical outer surface of the bushing for receiving and engaging the spherical outer surface of the bushing to provide pivoting movement of the seat relative to the support, wherein the socket and the bushing provide the sole means of constant engagement between the seat and the support for pivotably mounting the seat to the support;

wherein engagement between the socket and the bushing enables the seat to be moved throughout a range of angular positions relative to the shaft by movement of the socket on the bushing.

* * * * *